US011692782B2

(12) United States Patent
Couie

(10) Patent No.: US 11,692,782 B2
(45) Date of Patent: Jul. 4, 2023

(54) FIREARM MAGAZINE LOADER

(71) Applicant: William Christopher Couie, Vidalia, LA (US)

(72) Inventor: William Christopher Couie, Vidalia, LA (US)

( * ) Notice: Subject to any disclaimer, the term of this patent is extended or adjusted under 35 U.S.C. 154(b) by 11 days.

(21) Appl. No.: 17/323,600

(22) Filed: May 18, 2021

(65) Prior Publication Data

US 2022/0373280 A1 Nov. 24, 2022

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/84
See application file for complete search history.

(56) References Cited

U.S. PATENT DOCUMENTS

| | | | | |
|---|---|---|---|---|
| 4,538,371 | A | 9/1985 | Howard | |
| 4,570,371 | A | 2/1986 | Mears | |
| 6,810,616 | B2 | 11/2004 | Tal et al. | |
| 6,817,134 | B2 | 11/2004 | Newman | |
| 7,257,919 | B1 | 8/2007 | Farley | |
| 8,453,366 | B2 | 6/2013 | Gray | |
| 9,335,108 | B2 | 5/2016 | Cauley et al. | |
| 9,404,697 | B2 | 8/2016 | Cobb | |
| 10,001,331 | B2 | 6/2018 | Couie | |
| 10,598,456 | B1 * | 3/2020 | Tai | F41A 9/83 |
| 2004/0020096 | A1 | 2/2004 | Tal et al. | |
| 2013/0192117 | A1 | 8/2013 | Meinel | |
| 2013/0232843 | A1 | 9/2013 | Bajuelo | |
| 2014/0298704 | A1 | 10/2014 | Niccum | |

* cited by examiner

*Primary Examiner* — J. Woodrow Eldred

(74) *Attorney, Agent, or Firm* — Olav M. Underdal; IDP Patent Services

(57) ABSTRACT

A magazine loader includes a loader housing, including right and left sides, a front and rear connector members, and a bridge member; a loading plunger; a rear loading pusher; a protruding loading structure around a loading aperture in a side of the loader housing, and an unloading protrusion. Also disclosed is a method of using the magazine loader, including positioning magazine loader, positioning round, inserting round, loading round, and unloading round.

18 Claims, 23 Drawing Sheets

Method of using the magazine loader

FIREARM MAGAZINE LOADER

CROSS-REFERENCE TO RELATED APPLICATIONS

N/A.

FIELD OF THE INVENTION

The present invention relates generally to the field of firearm magazines, and more particularly to devices, methods and systems for loading a firearm magazine.

BACKGROUND OF THE INVENTION

Use of semi-automatic firearms require tedious and time-consuming loading of magazines. Loading devices are available, but are generally complicated devices, which only are capable of either loading or unloading.

As such, considering the foregoing, it may be appreciated that there continues to be a need for novel and improved devices and methods for loading and unloading a firearm magazine.

SUMMARY OF THE INVENTION

The foregoing needs are met, to a great extent, by the present invention, wherein in aspects of this invention, enhancements are provided to the existing model of loading and unloading a firearm magazine.

In an aspect, a magazine loader, can include:

a) a loader housing, which is hollow and defines a housing interior, such that the loader housing accepts a top of a firearm magazine, via insertion of the firearm magazine through a bottom opening of the loader housing; and b) a loading plunger, which is mounted on a bottom side of the bridge member, between the right and left sides; wherein, when an ammunition round is inserted into the interior below the loading plunger and the magazine loader is depressed downward: the loading plunger depresses the ammunition round downward into the firearm magazine, whereby the ammunition is seated within the firearm magazine.

In a related aspect, the magazine loader can further include a rear loading pusher, which is mounted behind and below the loading plunger, such that a front of the rear loading pusher protrudes at an inclination angle upward and inward from a rear of the loader housing;

such that the rear loading pusher is configured to push the ammunition round forward in the firearm magazine, when the magazine loader is depressed downward.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 1I is a cross-sectional side view of a magazine loader, taken along section line I-I of FIG. 1G, according to an embodiment of the invention.

DETAILED DESCRIPTION

Figure 1A:
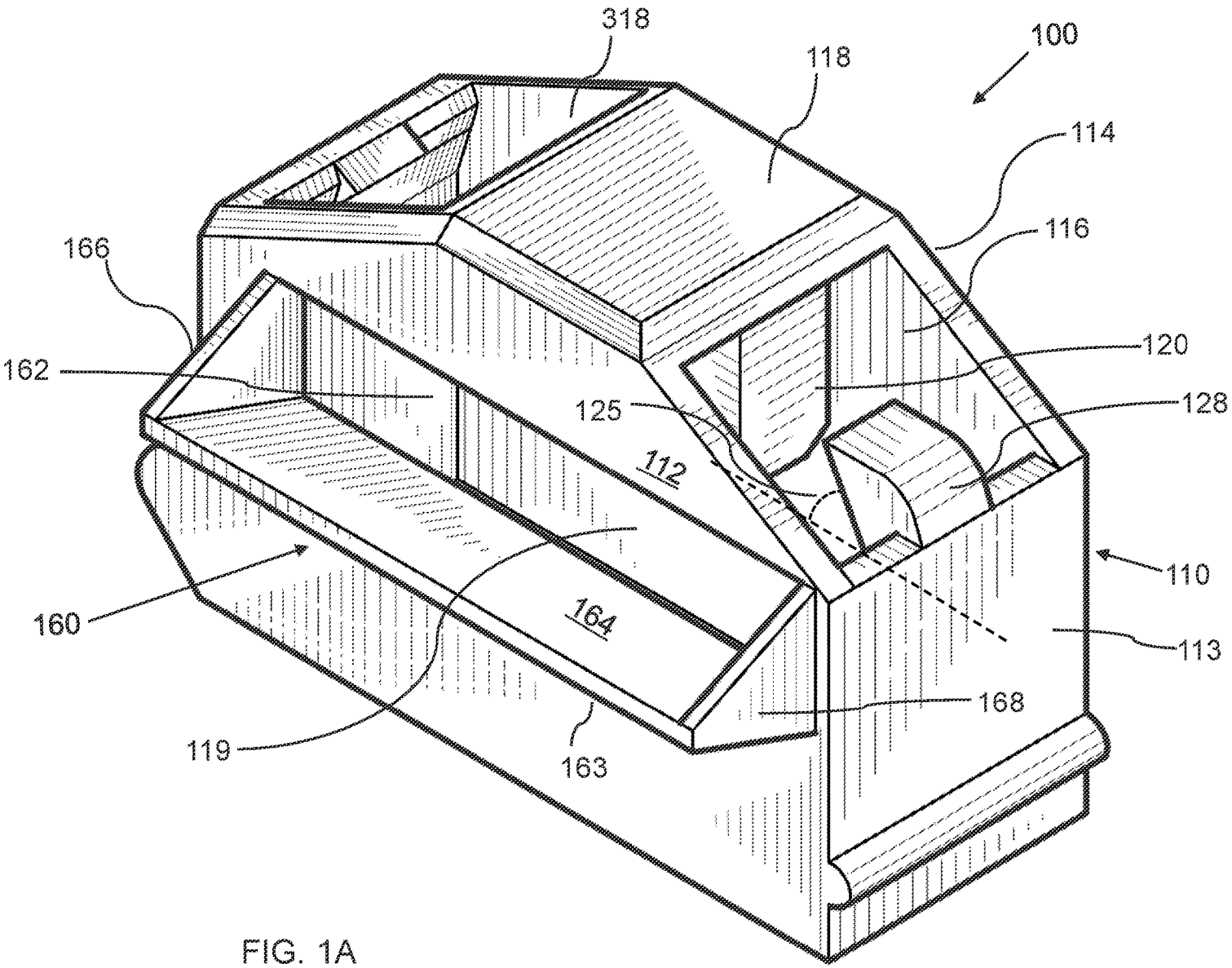
FIG. 1A is a rear perspective view of a magazine loader, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a magazine loader 100 with reference to FIG. 1, in such manner that like reference numerals refer to like components throughout; a convention that we shall employ for the remainder of this specification.

Figure 1B:
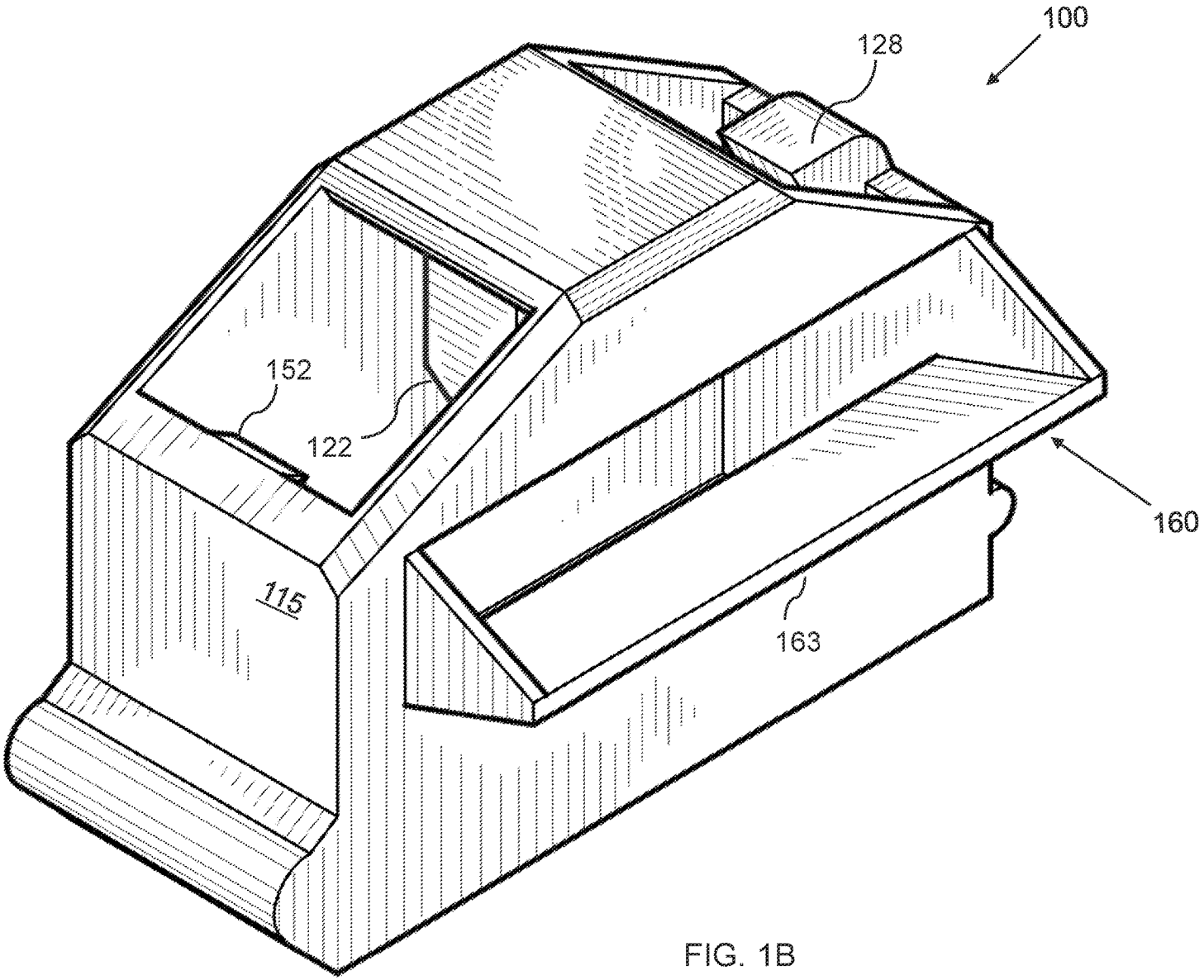
FIG. 1B is a front perspective view of a magazine loader, according to an embodiment of the invention.
Figure 1C:
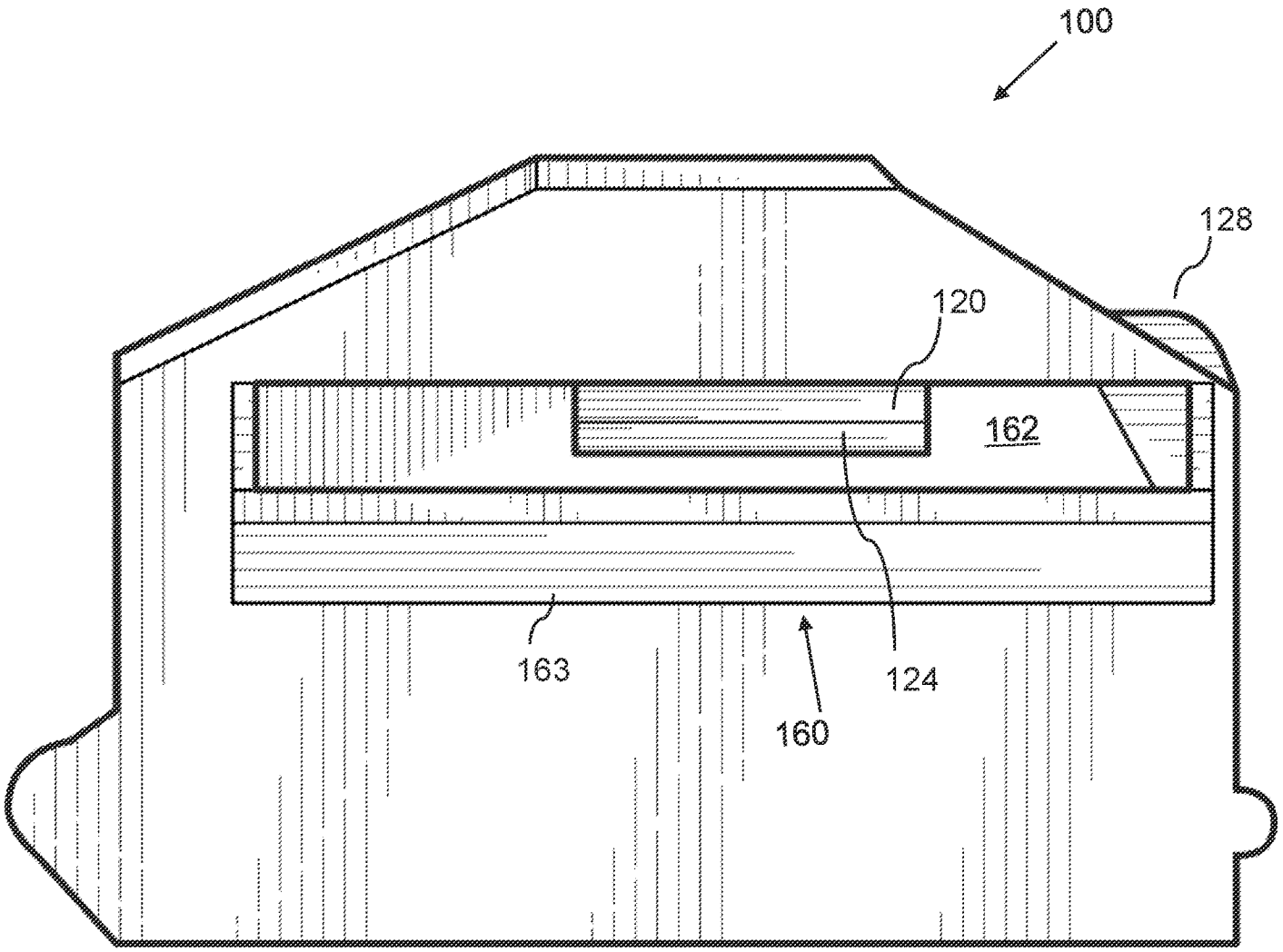
FIG. 1C is a left side view of a magazine loader, according to an embodiment of the invention.
Figure 1D:
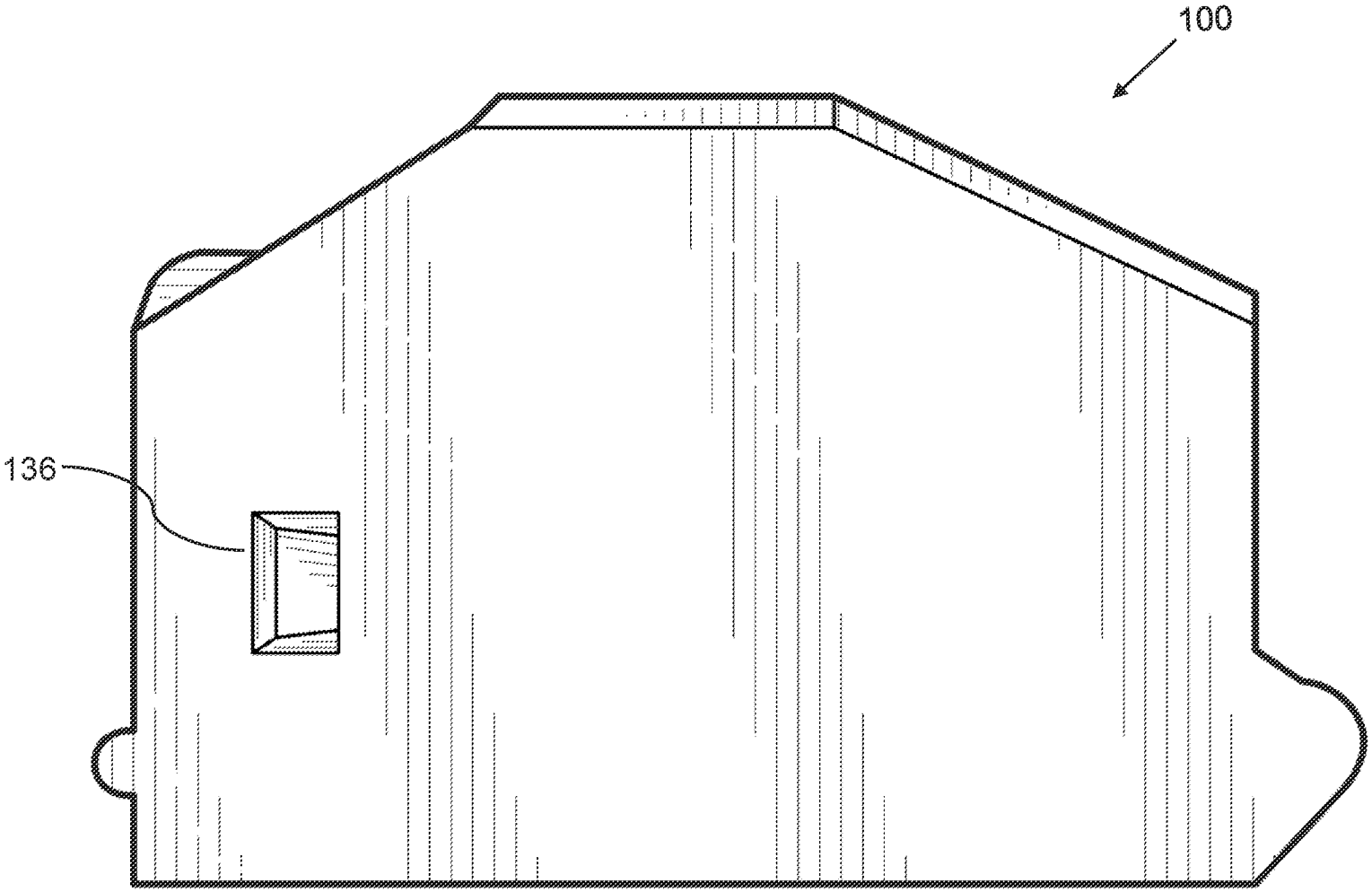
FIG. 1D is a right side view of a magazine loader, according to an embodiment of the invention.
Figure 1E:
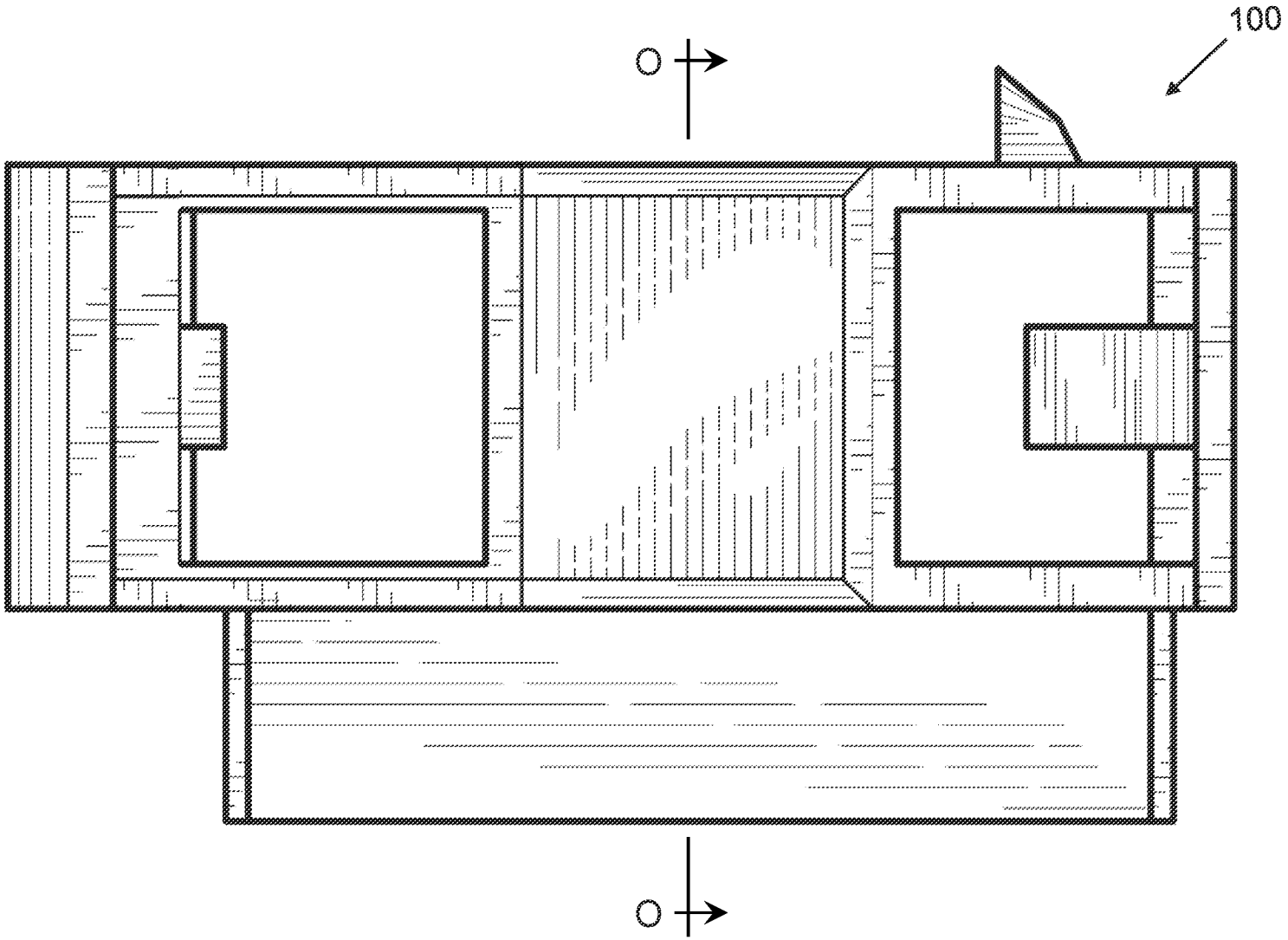
FIG. 1E is a top plan view of a magazine loader, according to an embodiment of the invention.
Figure 1F:
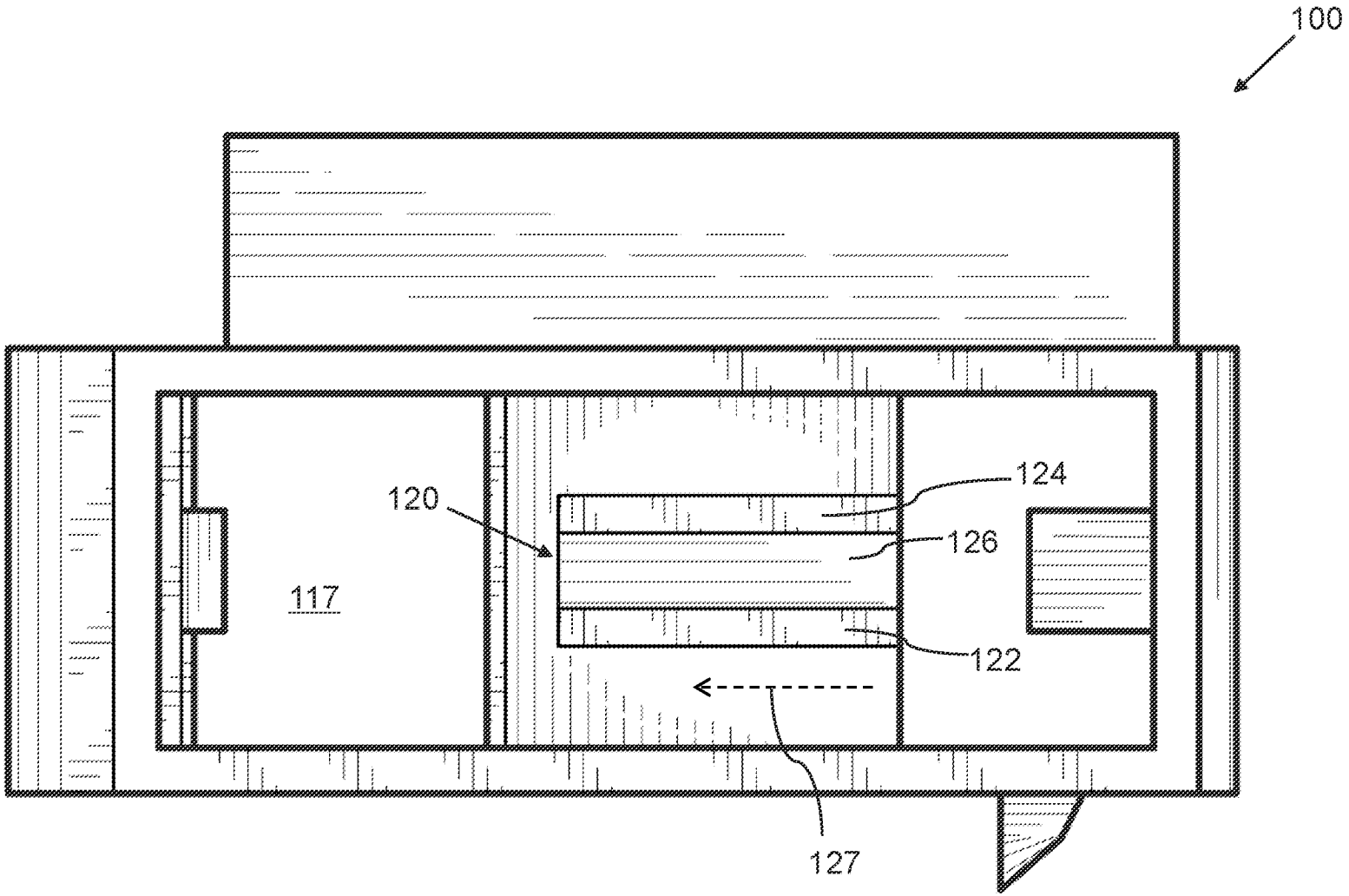
FIG. 1F is a bottom plan view of a magazine loader, according to an embodiment of the invention.
Figure 1G:
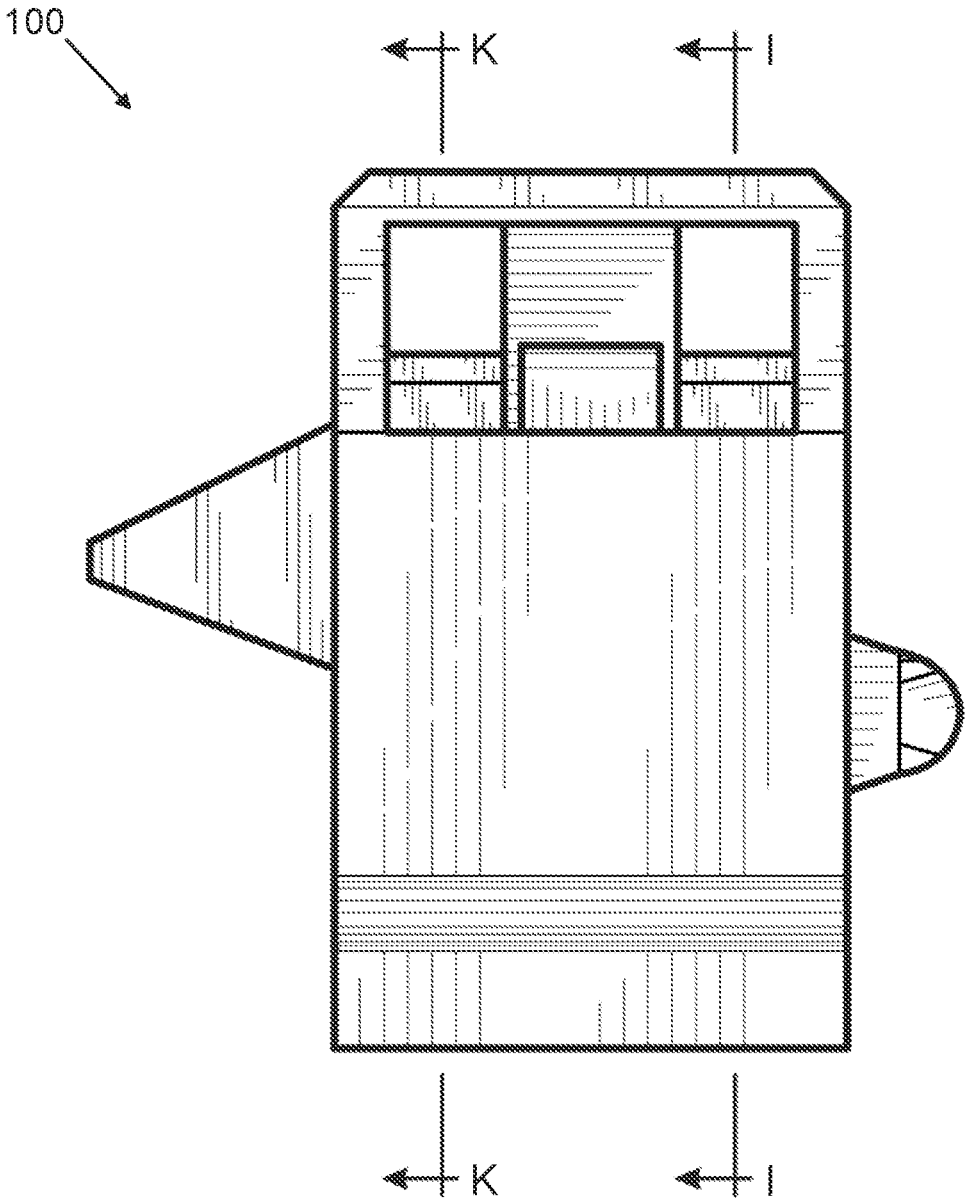
FIG. 1G is a rear view of a magazine loader, according to an embodiment of the invention.
Figure 1H:
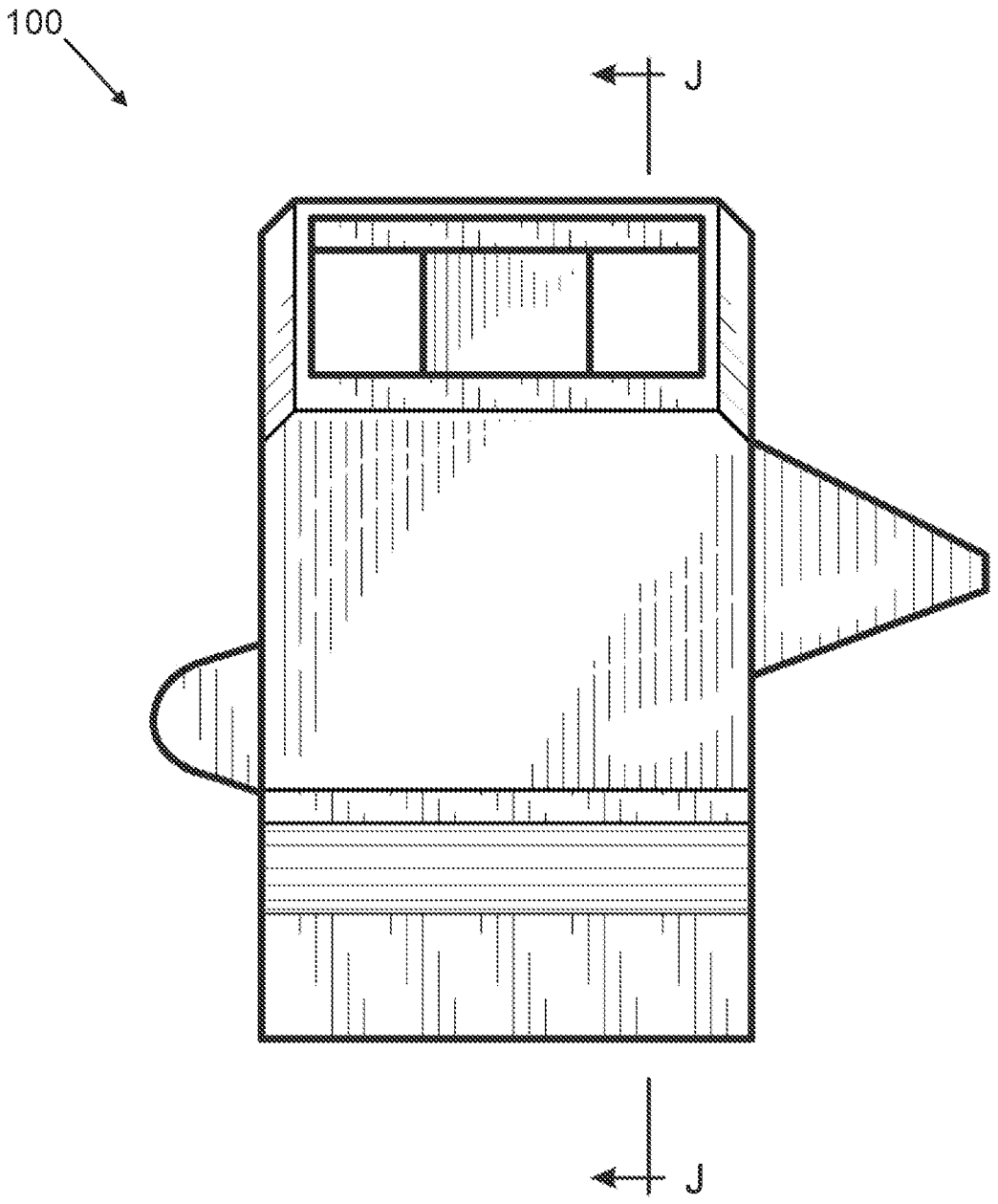
FIG. 1H is a front view of a magazine loader, according to an embodiment of the invention.
Figure 1I:
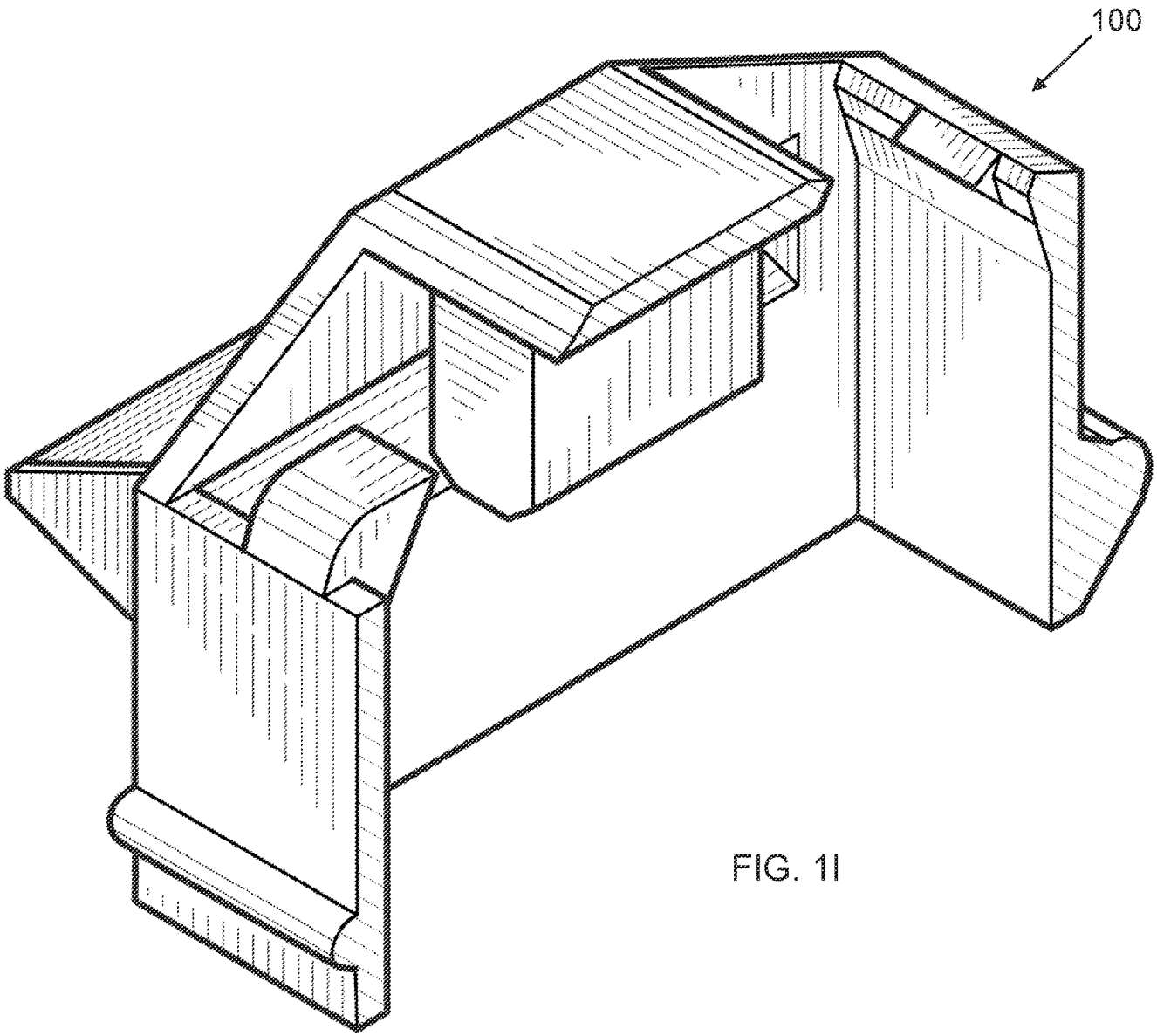
FIG. 1I is a cross-sectional perspective view of a magazine loader, taken along section line I-I of FIG. 1G, according to an embodiment of the invention.
Figure 1J:
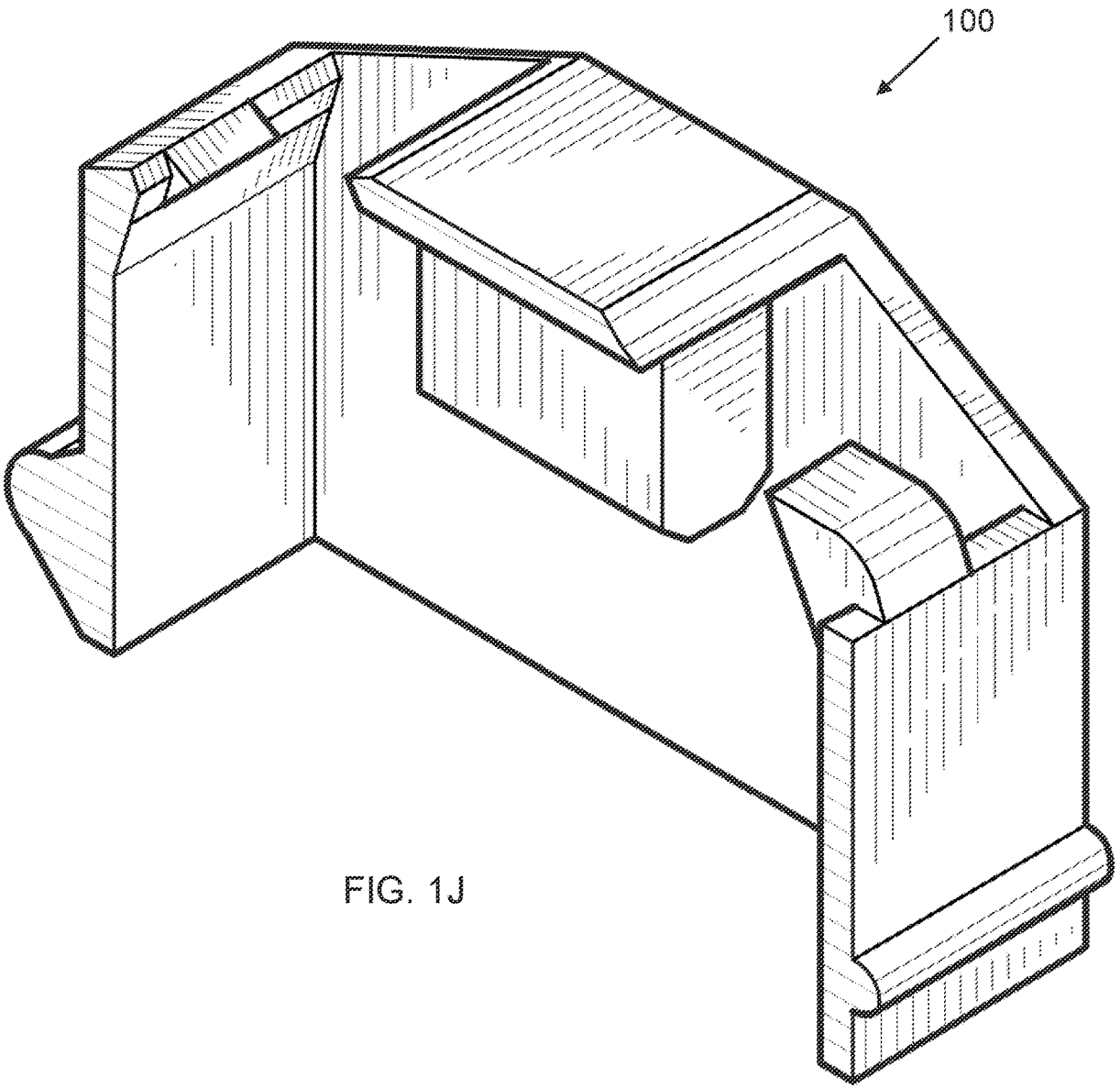
FIG. 1J is a cross-sectional perspective view of a magazine loader taken along section line J-J of FIG. 1H, according to an embodiment of the invention.
Figure 1K:
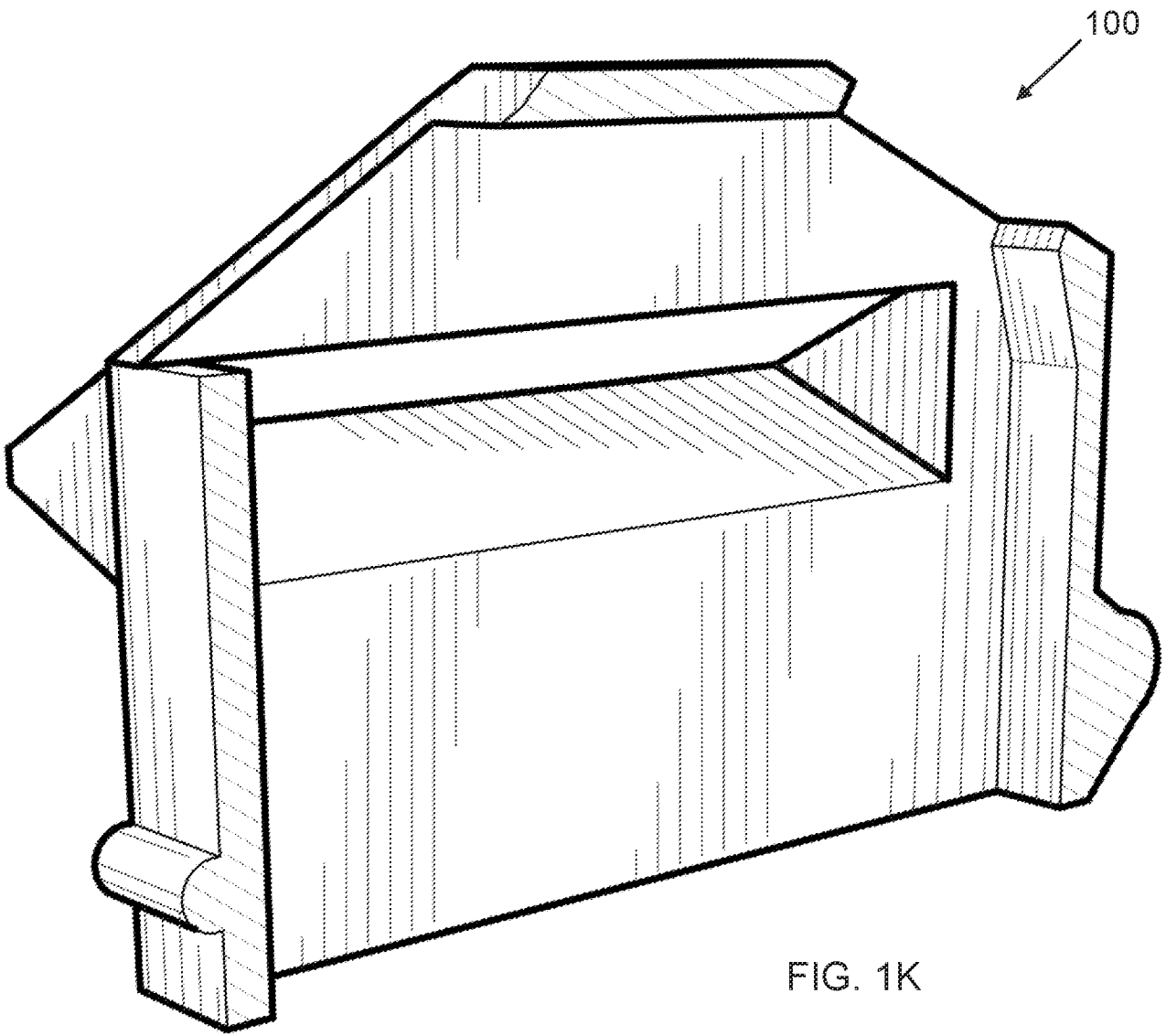
FIG. 1K is a cross-sectional perspective view of a magazine loader taken along section line K-K of FIG. 1G, according to an embodiment of the invention.
Figure 1L:
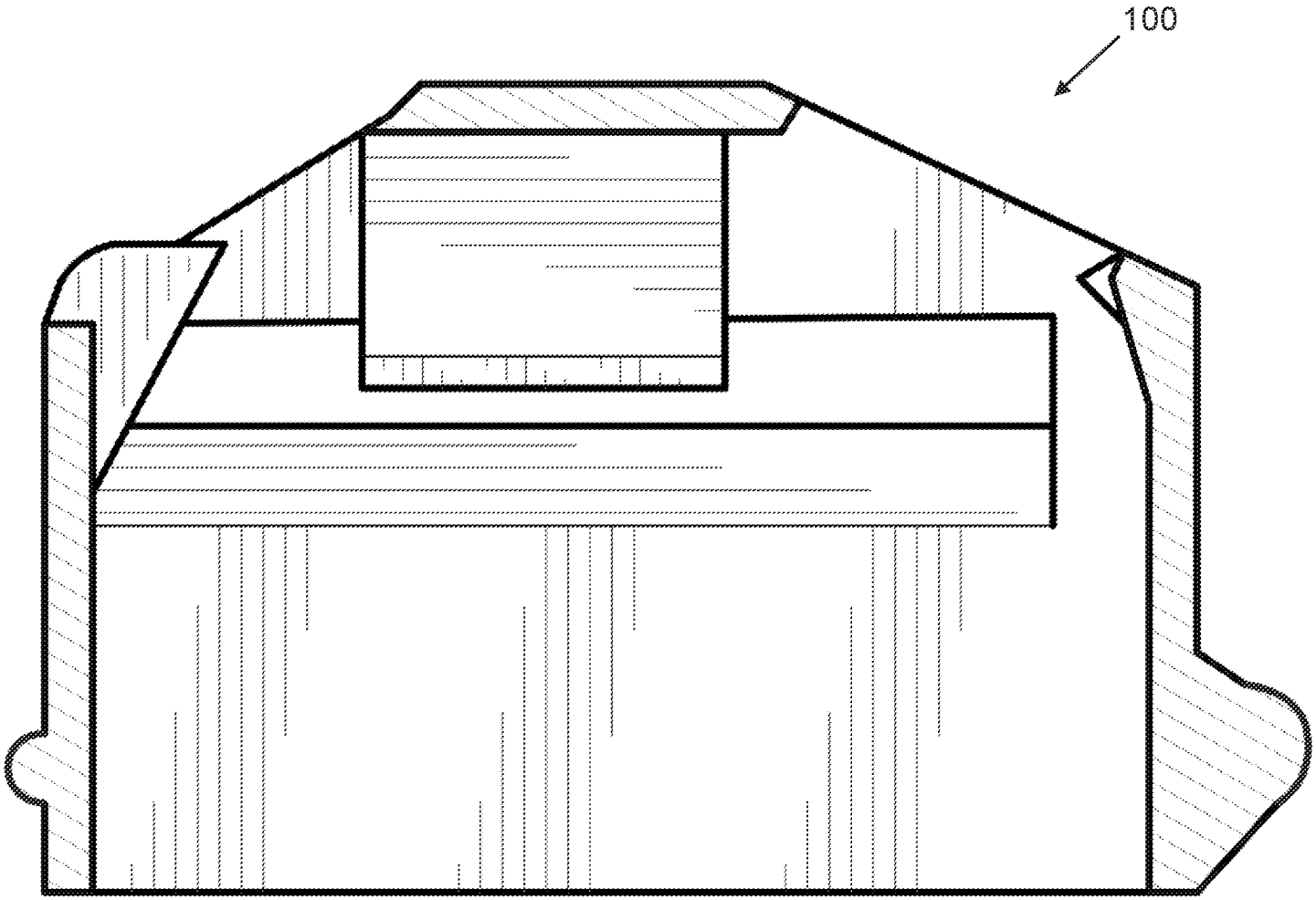
FIG. 1M is a cross-sectional side view of a magazine loader taken along section line J-J of FIG. 1H, according to an embodiment of the invention.
FIG. 1N is a cross-sectional side view of a magazine loader taken along section line K-K of FIG. 1G, according to an embodiment of the invention.
FIG. 1O is a cross-sectional front view of a magazine loader taken along section line O-O of FIG. 1E, according to an embodiment of the invention.
Figure 1M:
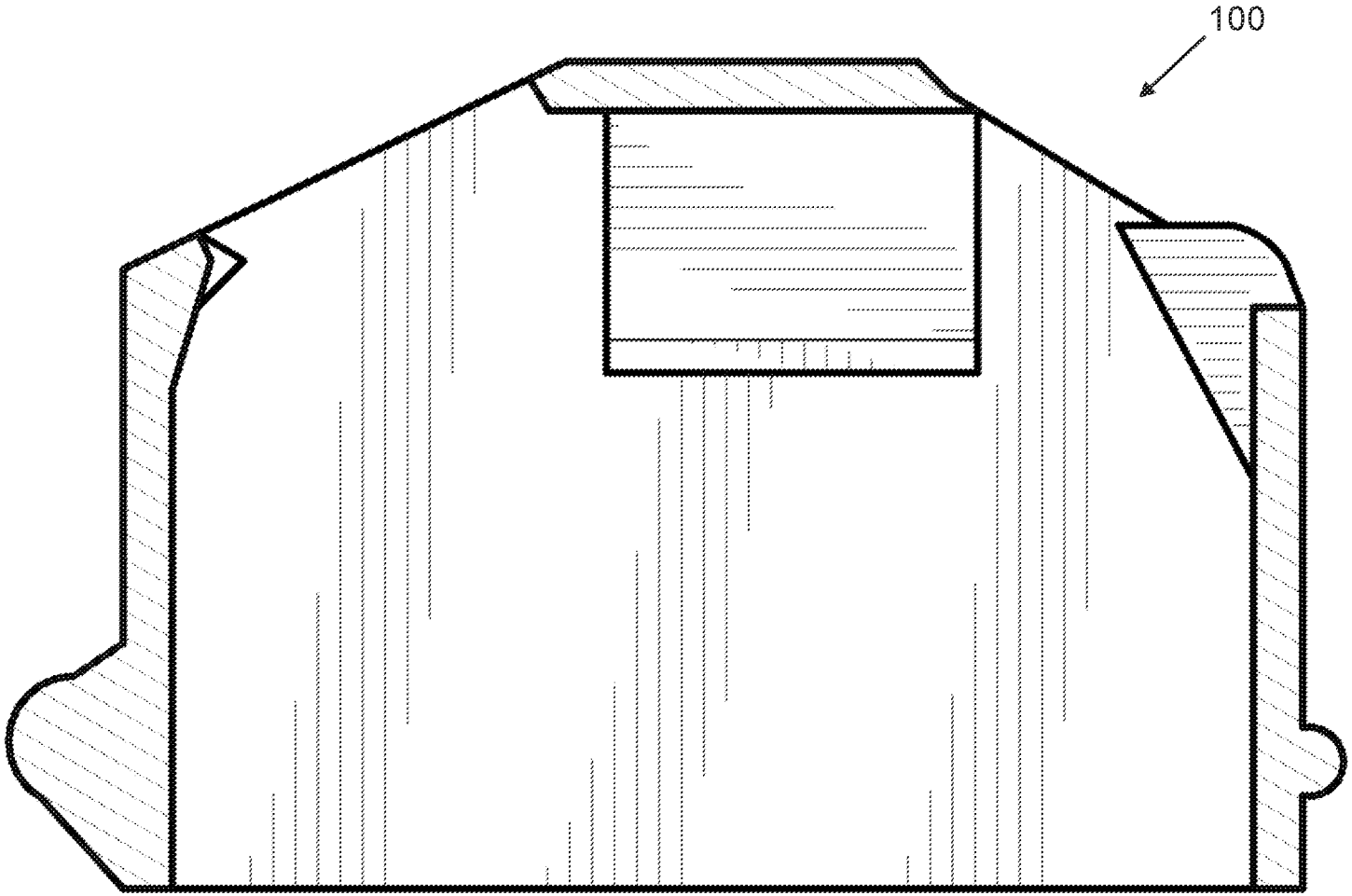
Figure 1N:
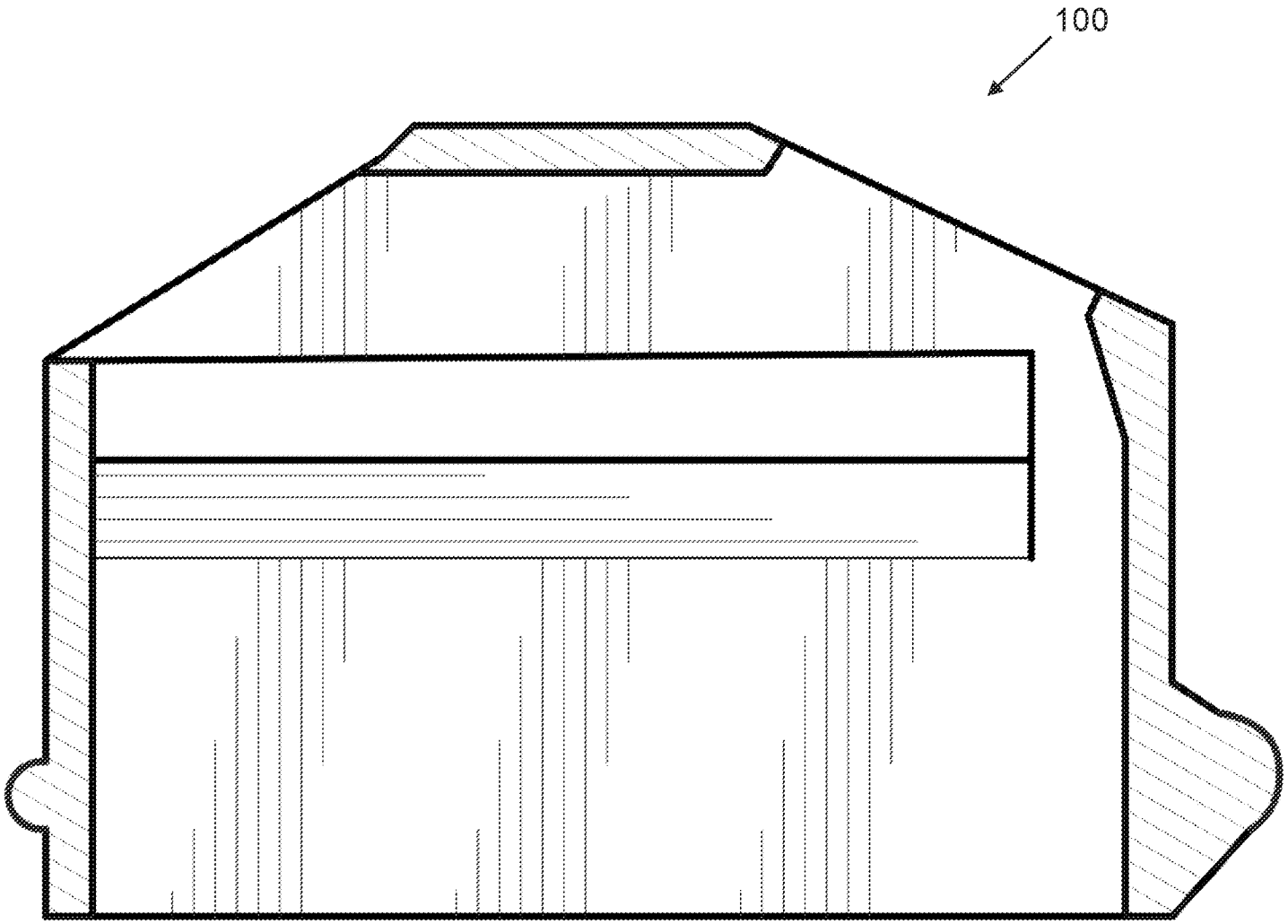
Figure 1O:
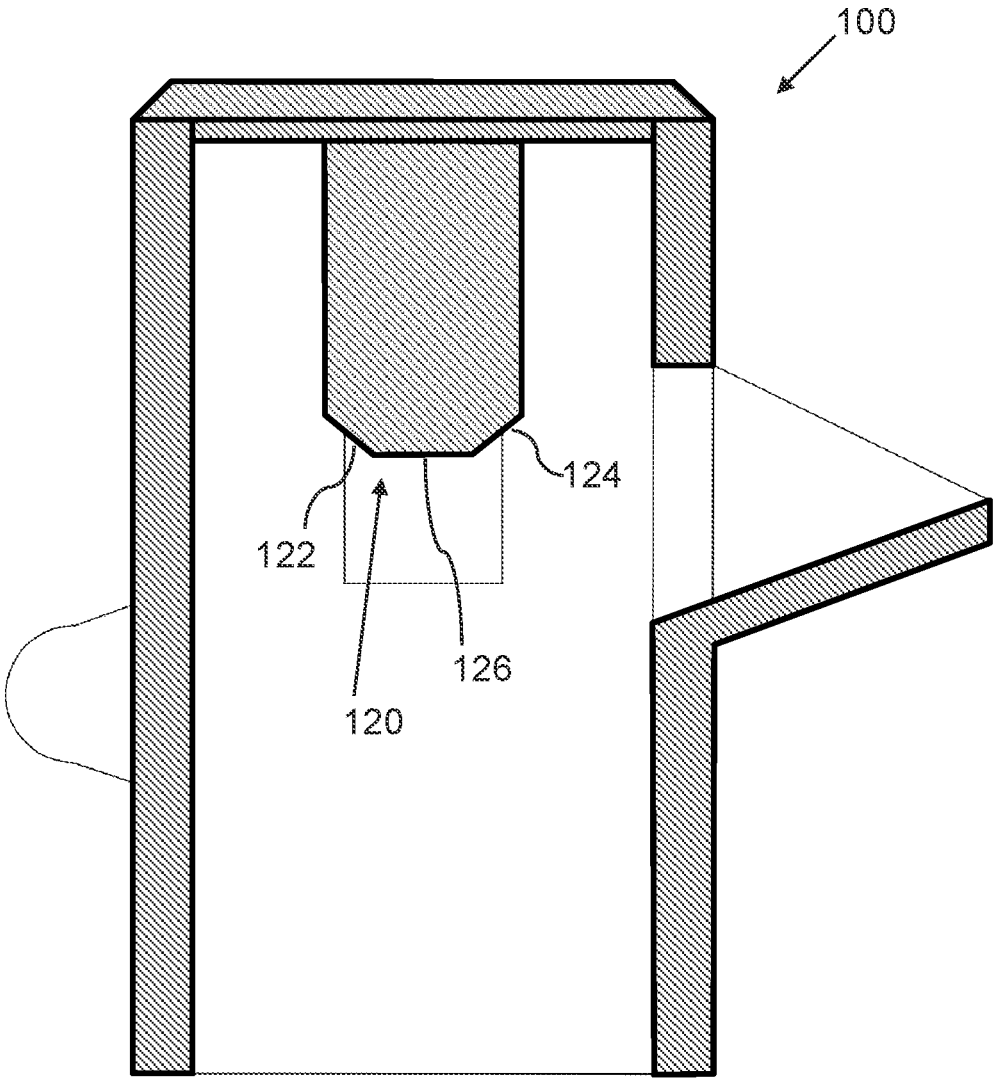
Figure 2A:
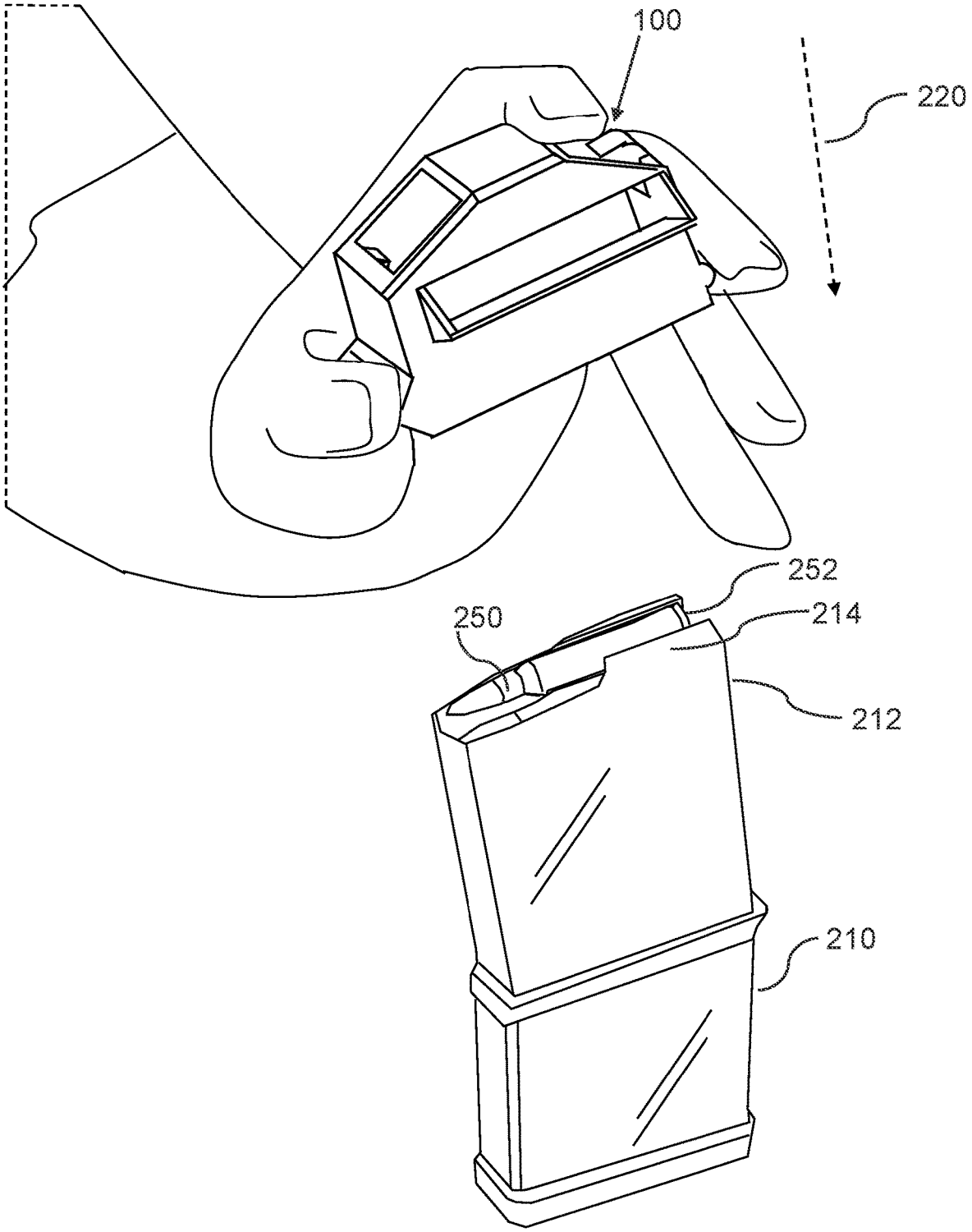
FIG. 2A is a perspective view of a magazine loader in use for loading a magazine, according to an embodiment of the invention.
Figure 2B:
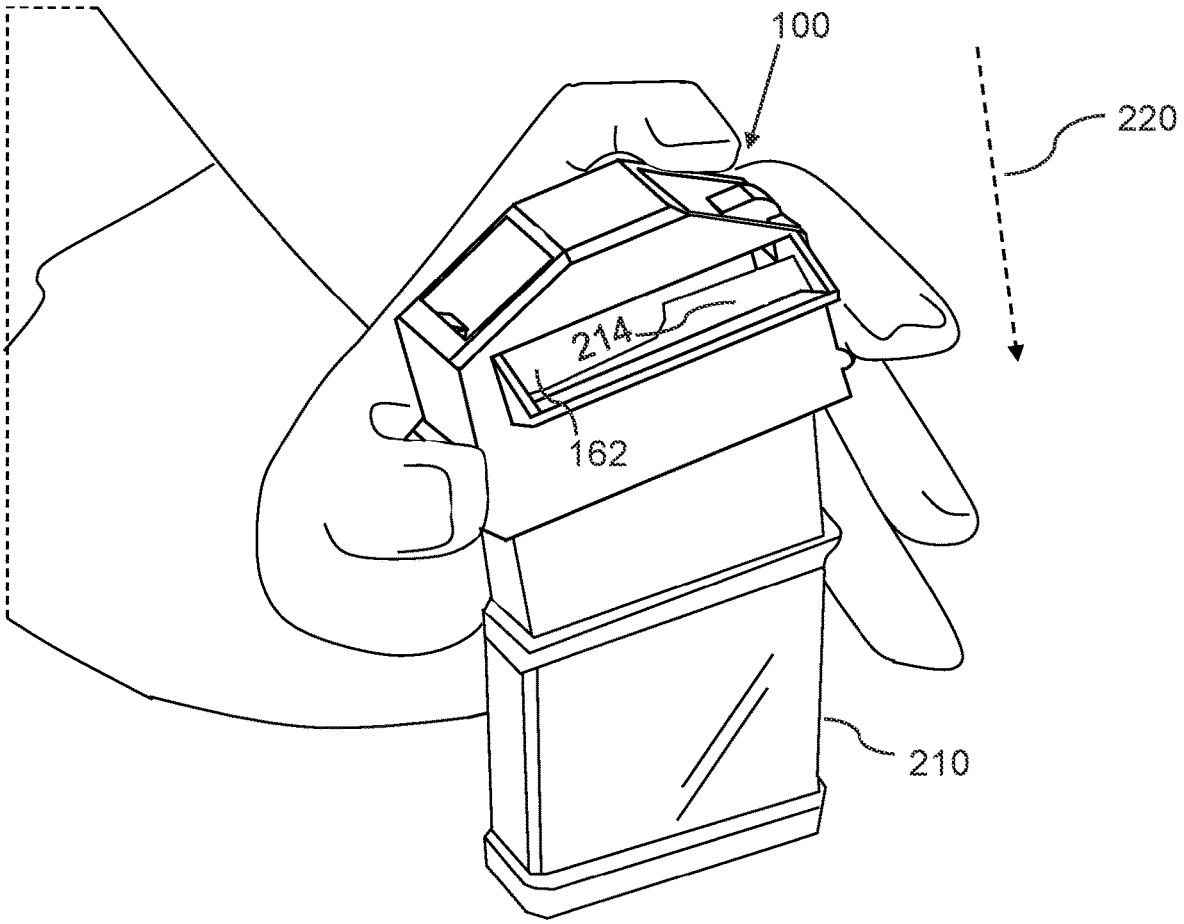
FIG. 2B is a perspective view of a magazine loader in use for loading a magazine, according to an embodiment of the invention.
Figure 2C:
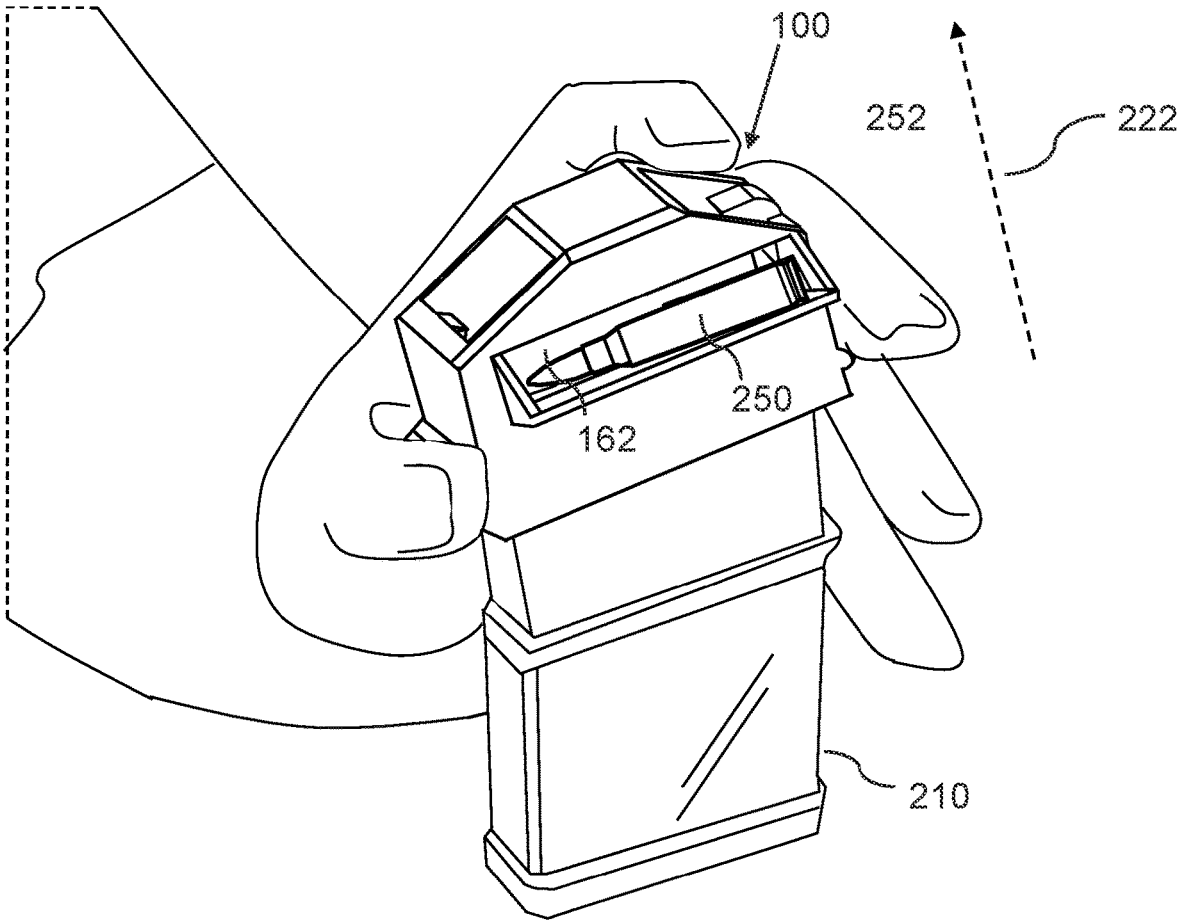
FIG. 2C is a perspective view of a magazine loader in use for loading a magazine, according to an embodiment of the invention.
Figure 2D:
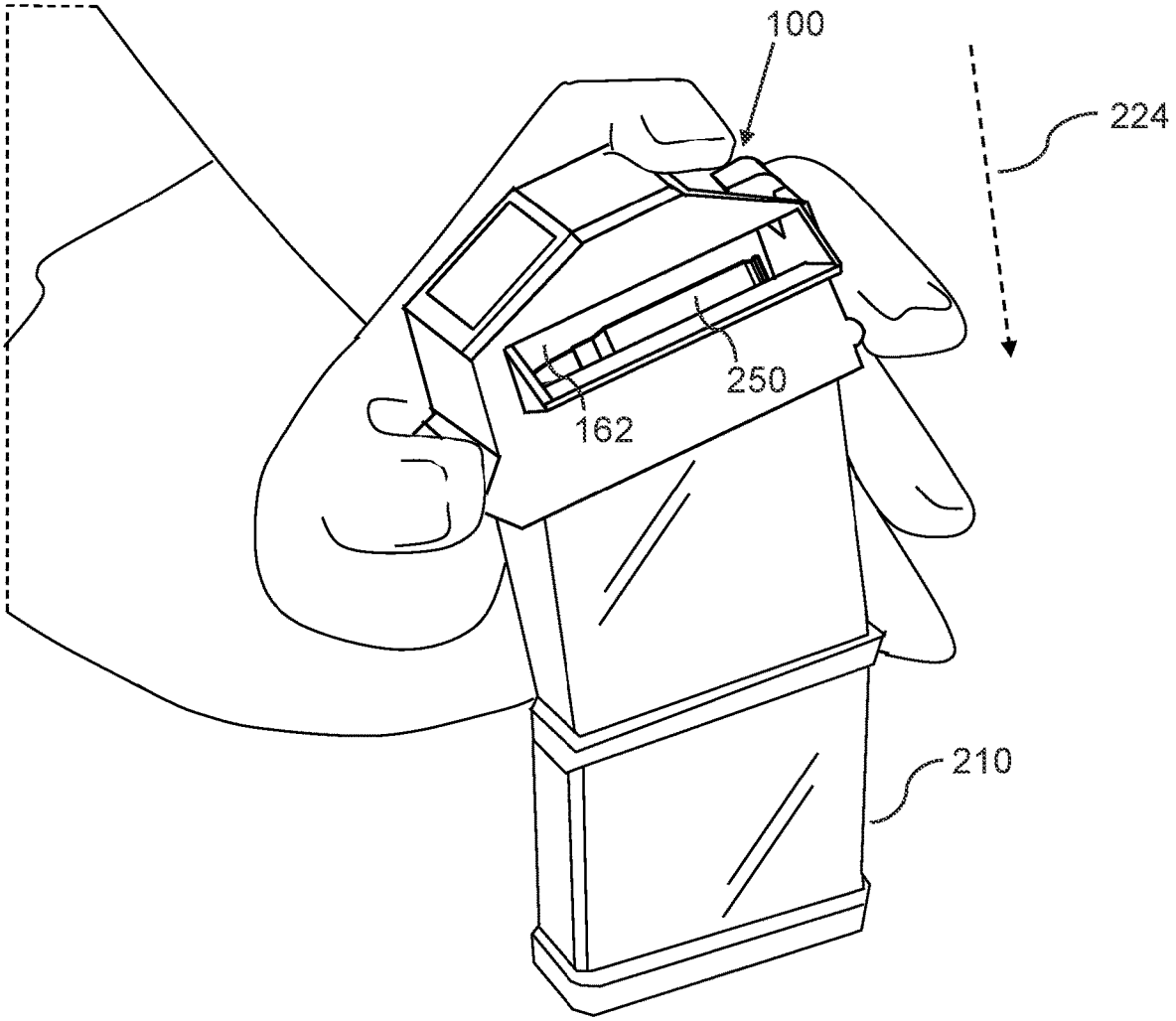
FIG. 2D is a perspective view of a magazine loader in use for loading a magazine, according to an embodiment of the invention.
Figure 3:
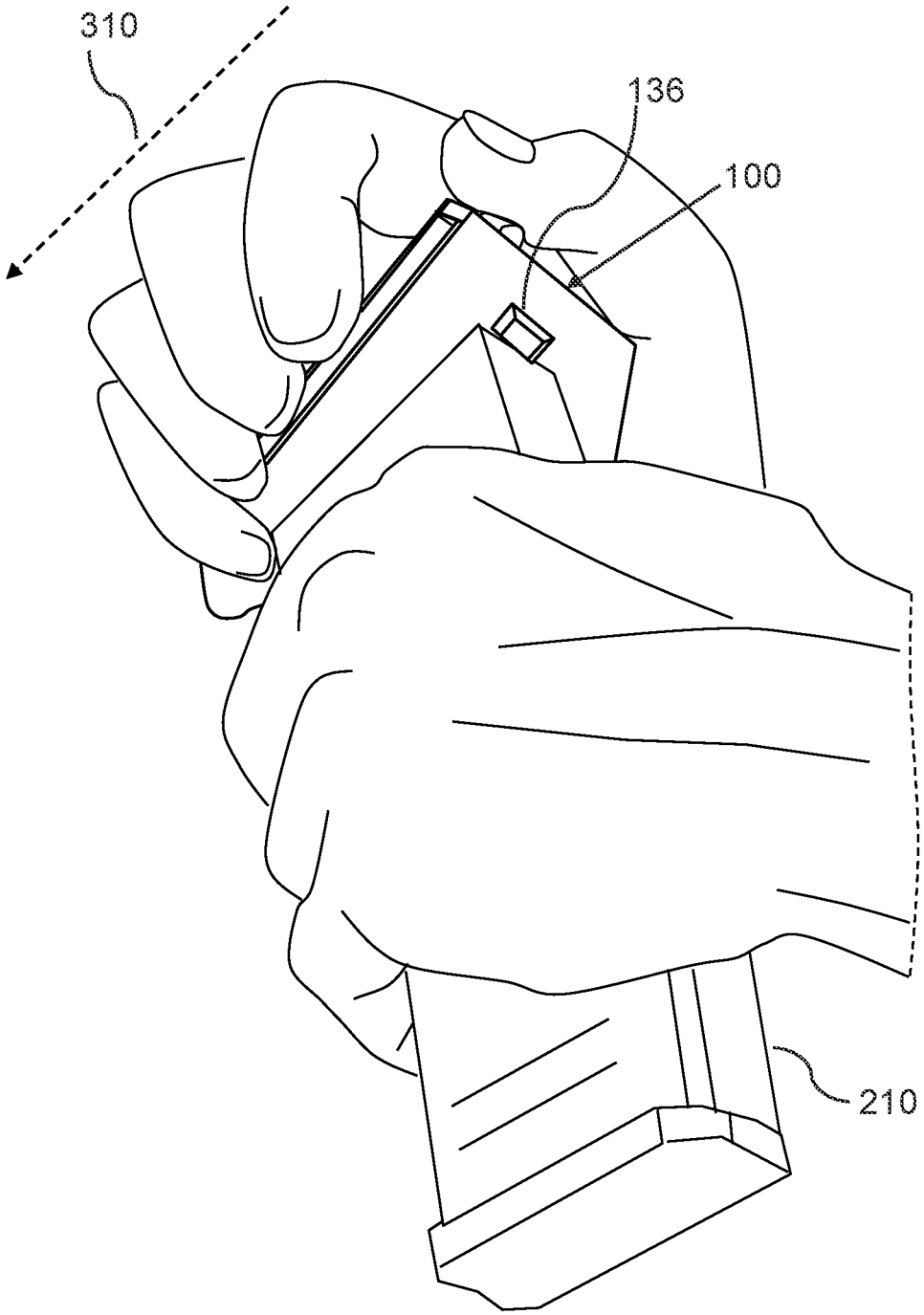
FIG. 3 is a perspective view of a magazine loader in use for unloading a magazine, according to an embodiment of the invention.

In an embodiment, as shown in FIGS. 1A-1K, a magazine loader 100 can include:

a) A loader housing 110, including:
   i. right and left sides 112 114;
   ii. a front connector member 113, which connects between front parts of the right and left sides 112 114;
   iii. a rear connector member 115, as shown in FIG. 1B, which connects between rear parts of the right and left sides 112 114; and
   iv. a bridge member 118, which connects between top parts of the right and left sides 112 114;
   such that the loader housing 110 is hollow and defines a housing interior 119, which is accessible via a front upper opening 116, a rear upper opening 318, the loading aperture 162, and a bottom opening 117, as shown in FIG. 1F;
   such that the loader housing 110, is configured to accept an upper end 212 of a firearm magazine 210, via insertion of the firearm magazine 210 through the bottom opening 117, as shown in FIGS. 2A and 2B;
   wherein a side of the loader housing 110 a configured with a loading aperture 162;

b) a loading plunger 120, which is mounted in an upper part 118 of the loader housing, such that the loading plunger protrudes downward into the housing interior, such that the loading plunger 120 can be mounted on a bottom side of the bridge member 118, between the right and left sides 112 114;

c) a rear loading pusher 128, which is mounted behind (i.e., to a rear of the loading plunger 120 and connected to a rear of the loader housing 110) and partially below the loading plunger 120, such that a front of the rear loading pusher 128 protrudes at an inclination angle 125 upward and inward from a rear 115 of the loader housing, which can be from the rear connector member 115;
   wherein, as shown in FIGS. 1A, 2C and 2D, when an ammunition round 250 is inserted via the loading aperture 162 into the housing interior 119 (as shown in FIG. 1A) below the loading plunger and the magazine loader 100 is depressed downward 224 onto the upper end 212 of the firearm magazine 210, the loading plunger 120, depresses the ammunition round 250 downward into the firearm magazine 210, such that the rear loading pusher 128 pushes the ammunition round 250 forward in the firearm magazine 210, whereby the ammunition is seated within the firearm magazine 210; and d) An unloading protrusion 136, which is mounted on an outer side of the loader housing 110, which can be either an outer side of the right or left sides 112 114;
   wherein, as shown in FIGS. 2A and 3, when the unloading protrusion 136 is placed on the upper end 212 of the firearm magazine 210 such that the unloading protrusion 136 is positioned against a rear of the firearm magazine 210 and the magazine loader 100 is pushed forward 310, the unloading protrusion 136 engages with a rear end 252 of the ammunition round 250 (as shown in FIG. 2A) and moves the ammunition round 250 forward, such that the ammunition round 250 is ejected from the firearm magazine 210.

In various related embodiments, the magazine loader 100 can alternatively be called a magazine loader/unloader 100, or a magazine loader and unloader 100.

In a related embodiment, the inclination angle 125 can be in a range of 25 to 85 degrees.

In another related embodiment, as shown in FIGS. 1B, 1C, 1F, and 1O a lower portion of the loading plunger 120 can be configured with:

a) right and left chamfered edges 122, 124 along an elongated/longitudinal direction 127 of the loading plunger (which corresponds with a longitudinal front to rear direction of the magazine loader 100); and b) a flat lower surface 126 between the right and left chamfered edges 122, 124, such that the flat lower surface 126 is configured to contact with the ammunition round 250 (when positioned in the housing interior 119 below the loading plunger 120) and press the ammunition round 250 down into the firearm magazine 210;

such that the right and left chamfered edges 122, 124 can aid in guiding the loading plunger 120 and ensure that right and left sides of the loading plunger 120 do not get stuck in or in contact with the firearm magazine 210. The right and left chamfered edges 122, 124 can also be referred to as right and left beveled edges 122, 124.

In another related embodiment, the magazine loader 100 can further include:

a) a protruding loading structure 160, which is connected to the loader housing 110 adjacent to a bottom of the loading aperture 162, such that the protruding loading structure 160 protrudes from the loader housing 110;

wherein the protruding loading structure 160 is configured with a downward angled loading surface 164 (from an outer edge of the protruding loading structure 160 to the loading aperture 162), which can be an upper surface 164 of a protruding member 163 of the protruding loading structure 160, wherein the protruding member 163 can be configured as a flat rectangular member; such that the downward angled loading surface 164 is configured to allow insertion of the ammunition round 250 in a longitudinal orientation, such that the ammunition round slides down the downward angled loading surface 164, through the loading aperture 162 and into the housing interior 119 of the loader housing 110.

In a further related embodiment, the protruding loading structure can further include:

a) a front end cap 166, which is connected to the loader housing 110 (adjacent to/along a front end of the loading aperture 162) and along a front end of the downward angled loading surface 164; and b) a rear end cap 168, which is connected to the loader housing 110 (adjacent to/along a rear end of the loading aperture 162) and along a front end of the downward angled loading surface 164;

such that the front end cap 166 and the rear end cap 168 are configured to contain the ammunition round 250 within the downward angled loading surface 164, when the ammunition round slides down the downward angled loading surface 164.

In a yet further related embodiment, the downward angled loading surface 164 can be configured as a flat surface. Alternatively, the downward angled loading surface 164 can be concave, for example with a cross-sectional parabolic curvature.

In a related embodiment, the magazine loader 100 can be manufactured in one piece, for example by injection molding or by additive manufacturing, such as fused deposition modeling. Alternatively, the magazine loader 100 can be assembled from separate pieces that are for example glued or fused together. The magazine loader can be made of a plastic material, or other suitable materials, such as metal, including rubber or plastic coated metal.

Figure 4A:
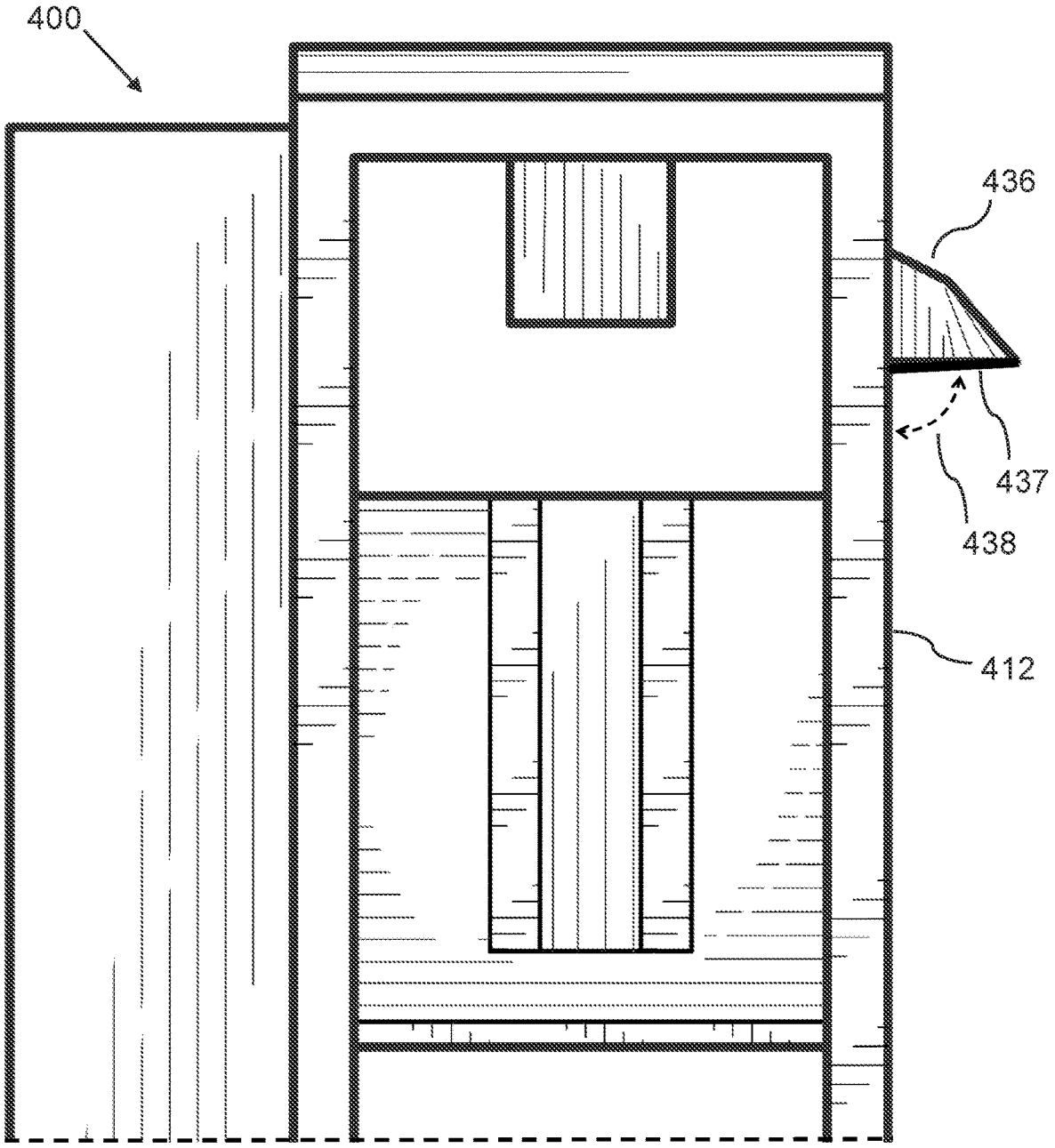
FIG. 4A is a top plan view of a part of a magazine loader, showing an unloading protrusion with an obtuse inclination angle, according to an embodiment of the invention.
Figure 4B:
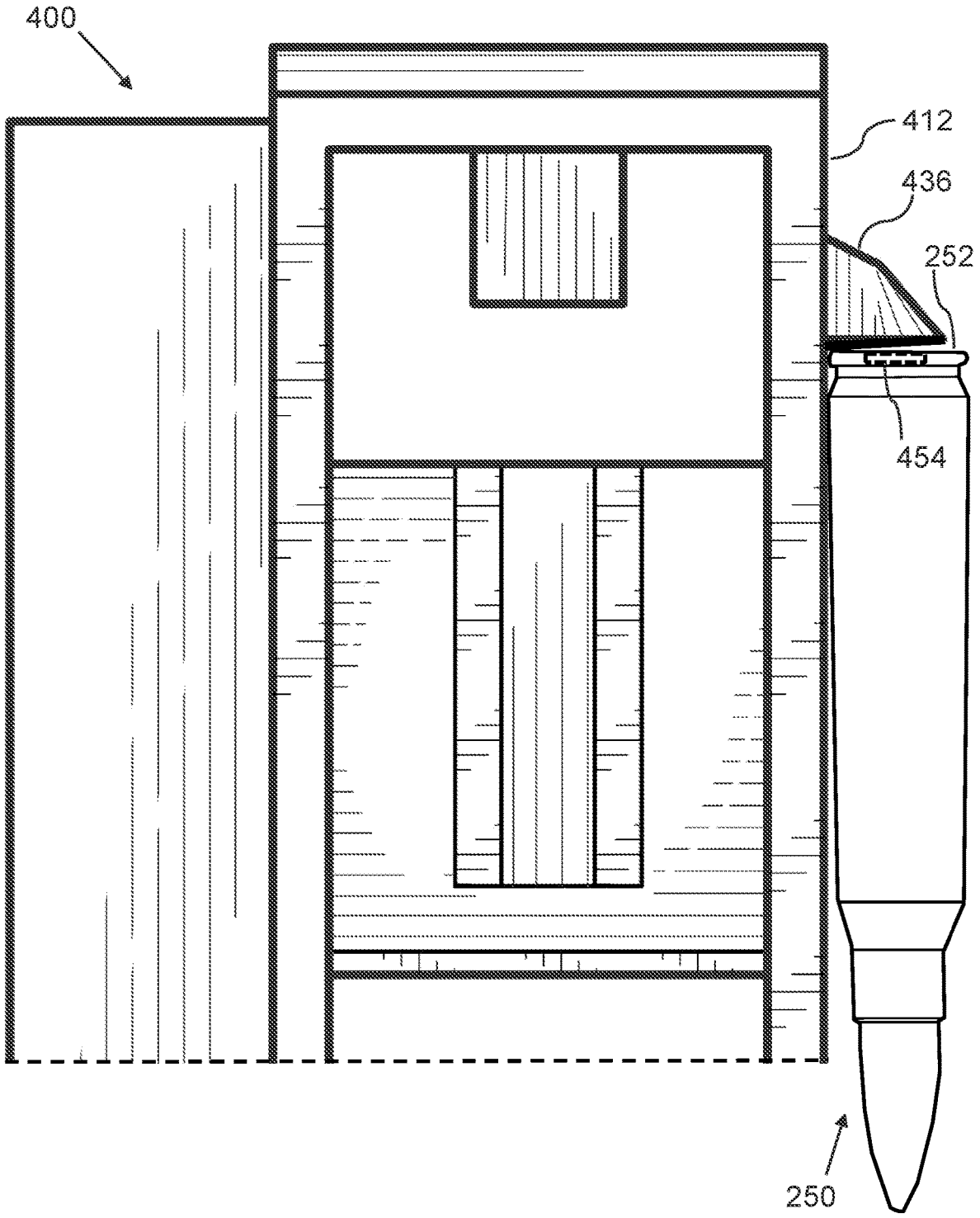
FIG. 4B is a top plan view of a part of a magazine loader, showing use of an unloading protrusion with an obtuse inclination angle, according to an embodiment of the invention.

In another related embodiment, as shown in FIGS. 4A and 4B, the magazine loader 400 can be configured such that a front surface 437 of the unloading protrusion 436 can be configured with an obtuse inclination angle 438, relative to a corresponding outer side 412 of a loader housing 110 of the magazine loader 400 from a top (or bottom) plan view, i.e. an obtuse inclination angle 438 between the front surface 437 and the corresponding side 412 of the magazine loader 400 (to which the unloading protrusion 136 is connected).

In a further related embodiment, the obtuse inclination angle 438 can be in a range of 90.2 to 95 degrees, or 90.1 to 100 degrees, or a wider range, such that the obtuse inclination angle 438 ensures that the unloading protrusion 436 cannot contact with an ammunition primer 454 in a rear end 252 of the round 250. FIG. 4A shows the front surface 437 of the unloading protrusion 436 configured with a 93-degree obtuse inclination angle 438.

Figure 5:
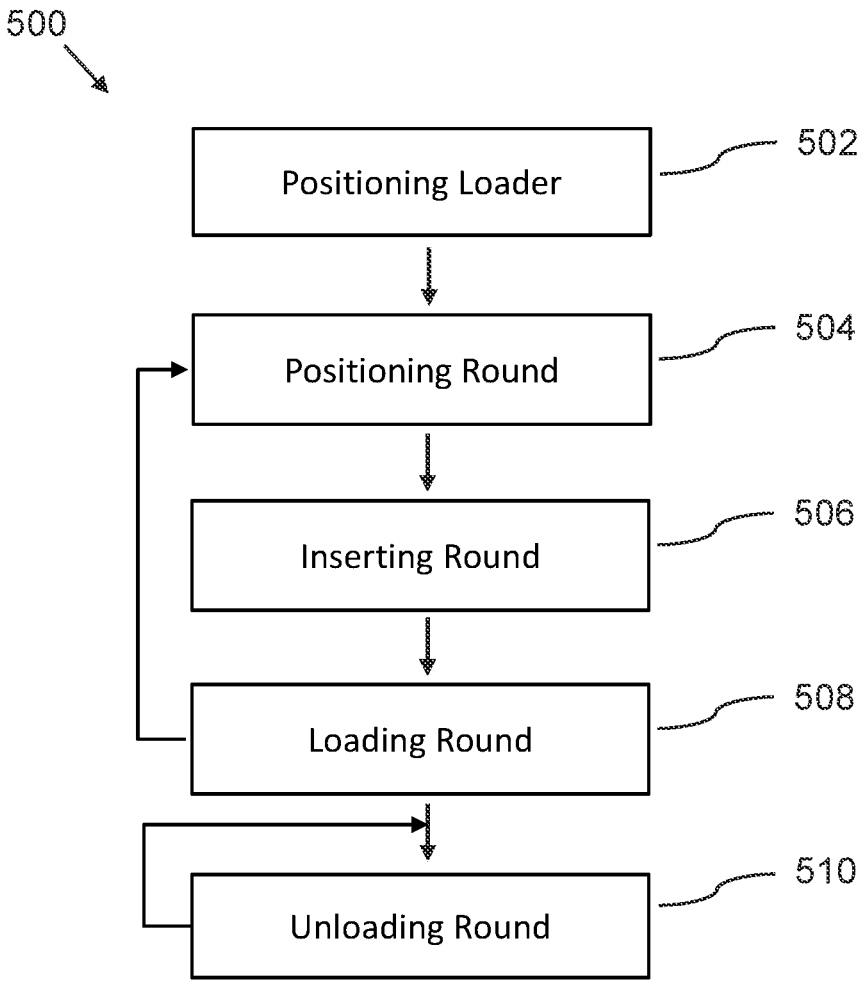
FIG. 5 is a flowchart illustrating steps that may be followed, in accordance with one embodiment of a method or process of using a magazine loader.

In an embodiment, as shown in FIG. 5, a method of using the magazine loader 500 can include:

a) Positioning the magazine loader 502, wherein the magazine loader is pressed down 220 onto the firearm magazine 210, as shown in FIGS. 2A and 2B;

b) Positioning round 504, wherein an ammunition round 250 is inserted into a protruding loading structure 160 of the magazine loader 100, such that a portion of the round 250 protrudes through a loading aperture 162 in a side of the magazine loader and rests against a top 214 of the firearm magazine 210;

c) Inserting round 506, wherein the magazine loader 100 is moved vertically upwards 222, until the round clears the top of the firearm magazine 210, such that the ammunition round 250 drops from the protruding loading structure 160 into an interior 119 of the magazine loader 100, via the loading aperture 162, while holding an upper end of the firearm magazine inserted into a bottom of the magazine loader 100, such that the loading plunger 120 of the magazine loader 100 is positioned sufficiently high to allow the ammunition round 250 to be inserted into the interior 119 of the magazine loader 100;

d) Loading round 508, wherein the magazine loader 100 is depressed downward 224, such that the magazine loader 100 slides further down over the firearm magazine 210, such that the loading plunger 120 depresses the ammunition round 250 downward into the firearm magazine 210, such that the rear loading pusher 128 pushes the ammunition round 250 forward in the firearm magazine 210, whereby the ammunition is seated within the firearm magazine 210;

wherein the process of positioning round 504, inserting round 506 and loading round 508 can be repeated until the firearm magazine 210 is full; and e) Unloading round 510, wherein the magazine loader 100 is held on a side that includes an unloading protrusion 136, and is placed on a top of the firearm magazine 210 such that the unloading protrusion 136 is positioned against a rear of the firearm magazine 210, such that the magazine loader 100 is pushed forward 310, such that the unloading protrusion 136 engages with a rear end of the ammunition round 250 and moves the ammunition round 250 forward, such that the ammunition round 250 is ejected from the firearm magazine 210;

wherein the firearm magazine 210 can be emptied by sliding the magazine loader 100 back to the original position and repeating unloading round 510 until the firearm magazine 210 is unloaded to a desired level, such as for example completely unloaded.

Here has thus been described a multitude of embodiments of the magazine loader 100 and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A magazine loader, comprising:

a) a loader housing, which is hollow and defines a housing interior, such that the loader housing is configured to accept an upper end of a firearm magazine, via insertion of the firearm magazine through a bottom opening of the loader housing;

wherein a side of the loader housing is configured with a loading aperture;

b) a loading plunger, which is mounted in an upper part of the loader housing, such that the loading plunger protrudes into the housing interior; and c) a protruding loading structure, which is connected to the loader housing adjacent to a bottom of the loading aperture, such that the protruding loading structure protrudes from the loader housing;

such that, when an ammunition round is inserted via the loading aperture into the housing interior below the loading plunger and the magazine loader is depressed downward onto the upper end of the firearm magazine, the loading plunger is configured to depress the ammunition round downward into the firearm magazine, whereby the ammunition is seated within the firearm magazine;

wherein the protruding loading structure is configured with a downward angled loading surface;

such that the downward angled loading surface is configured to allow insertion of the ammunition round in a longitudinal orientation, such that the ammunition round slides down the downward angled loading surface, through the loading aperture, and into the housing interior of the loader housing.

2. The magazine loader of claim 1, further comprising:

a rear loading pusher, which is mounted behind the loading plunger, such that a front of the rear loading pusher protrudes at an inclination angle upward and inward from a rear of the loader housing;

such that the rear loading pusher is configured to push the ammunition round forward in the firearm magazine, when the magazine loader is depressed downward.

3. The magazine loader of claim 1, wherein the protruding loading structure further comprises:

a front end cap, which is connected to the loader housing along a front end of the loading aperture and along a front end of the downward angled loading surface; and a rear end cap, which is connected to the loader housing along a rear end of the loading aperture and along a front end of the downward angled loading surface;

such that the front end cap and the rear end cap are configured to contain the ammunition round within the downward angled loading surface, when the ammunition round slides down the downward angled loading surface.

4. The magazine loader of claim 1, wherein the loader housing further comprises:

a) right and left sides; and b) a bridge member, which connects between top parts of the right and left sides;

wherein the loading plunger is mounted on a bottom side of the bridge member, between the right and left sides.

5. The magazine loader of claim 4, wherein the loader housing further comprises:

a) a front connector member, which connects between front parts of the right and left sides; and b) a rear connector member, which connects between rear parts of the right and left sides;

such that the housing interior is configured to be accessible via a front upper opening, a rear upper opening, the loading aperture, and the bottom opening.

6. The magazine loader of claim 1, further comprising:

an unloading protrusion, which is mounted on an outer side of the loader housing;

wherein, when the unloading protrusion is placed on a top of the firearm magazine, such that the unloading protrusion is positioned against a rear of the firearm magazine and the magazine loader is pushed forward, the unloading protrusion is configured to engage with a rear end of the ammunition round and move the ammunition round forward, such that the ammunition round is ejected from the firearm magazine.

7. The magazine loader of claim 6, wherein a front surface of the unloading protrusion is configured with an obtuse inclination angle, relative to the outer side of the loader housing, such that the obtuse inclination angle ensures that the unloading protrusion cannot contact with an ammunition primer in the rear end of the ammunition round.

8. The magazine loader of claim 7, wherein the obtuse inclination angle is configured in a range of 90.2 to 95 degrees.

9. The magazine loader of claim 1, wherein the magazine loader is manufactured in one piece.

10. The magazine loader of claim 1, wherein a lower portion of the loading plunger is configured with right and left chamfered edges along a longitudinal direction of the loading plunger.

11. A method of using a magazine loader, comprising:

a) positioning the magazine loader, wherein the magazine loader is pressed down onto a firearm magazine;

b) positioning round, wherein an ammunition round is inserted into a protruding loading structure of the magazine loader, such that a portion of the ammunition round protrudes through a loading aperture in a side of the magazine loader and rests against a top of the firearm magazine;

c) inserting round, wherein the magazine loader is moved vertically upwards, until the ammunition round clears the top of the firearm magazine, such that the ammunition round drops from the protruding loading structure into a housing interior of the magazine loader, via the loading aperture; and d) loading round, wherein the magazine loader is depressed downward, such that the magazine loader slides down over the firearm magazine, such that a loading plunger of the magazine loader depresses the ammunition round downward into the firearm magazine, whereby the ammunition round is seated within the firearm magazine;

wherein the magazine loader comprises:

a loader housing, which is hollow and defines the housing interior, such that the loader housing is configured to accept an upper end of the firearm magazine, via insertion of the firearm magazine through a bottom opening of the loader housing;

wherein a side of the loader housing is configured with the loading aperture;

the loading plunger, which is mounted in an upper part of the loader housing, such that the loading plunger protrudes into the housing interior; and a protruding loading structure, which is connected to the loader housing adjacent to a bottom of the loading aperture, such that the protruding loading structure protrudes from the loader housing;

wherein, when an ammunition round is inserted into the housing interior below the loading plunger and the magazine loader is depressed downward, the loading plunger is configured to depress the ammunition round downward into the firearm magazine, whereby the ammunition is seated within the firearm magazine;

wherein the protruding loading structure is configured with a downward angled loading surface;

such that the downward angled loading surface is configured to allow insertion of the ammunition round in a longitudinal orientation, such that the ammunition round slides down the downward angled loading surface, through the loading aperture, and into the housing interior of the loader housing.

12. The method of using a magazine loader of claim 11, further comprising:

unloading round, wherein the magazine loader is held on a side that includes an unloading protrusion, such that the unloading protrusion is placed on a top of the firearm magazine, such that the unloading protrusion is positioned against a rear of the firearm magazine, such that the magazine loader is pushed forward, such that the unloading protrusion engages with a rear end of the ammunition round and moves the ammunition round forward, such that the ammunition round is ejected from the firearm magazine;

wherein the magazine loader further comprises:

the unloading protrusion, which is mounted on an outer side of the loader housing.

13. The method of using a magazine loader of claim 12, wherein a front surface of the unloading protrusion is configured with an obtuse inclination angle, relative to the outer side of the loader housing, such that the obtuse inclination angle ensures that the unloading protrusion cannot contact with an ammunition primer in the rear end of the ammunition round.

14. The method of using a magazine loader of claim 13, wherein the obtuse inclination angle is configured in a range of 90.2 to 95 degrees.

15. The method of using a magazine loader of claim 11, wherein d) loading round further comprises that a rear loading pusher depresses the ammunition round forward in the firearm magazine;

wherein the magazine loader further comprises:

the rear loading pusher, which is mounted behind the loading plunger, such that a front of the rear loading pusher protrudes at an inclination angle upward and inward from a rear of the loader housing;

such that the rear loading pusher is configured to push the ammunition round forward in the firearm magazine, when the magazine loader is depressed downward.

16. The method of using a magazine loader of claim 11, wherein the protruding loading structure further comprises:

a front end cap, which is connected to the loader housing along a front end of the loading aperture and along a front end of the downward angled loading surface; and a rear end cap, which is connected to the loader housing along a rear end of the loading aperture and along a front end of the downward angled loading surface;

such that the front end cap and the rear end cap are configured to contain the ammunition round within the downward angled loading surface, when the ammunition round slides down the downward angled loading surface.

17. The method of using a magazine loader of claim 11, wherein the loader housing further comprises:

a) right and left sides; and b) a bridge member, which connects between top parts of the right and left sides;

wherein the loading plunger is mounted on a bottom side of the bridge member, between the right and left sides.

18. The method of using a magazine loader of claim 17, wherein the loader housing further comprises:

a) a front connector member, which connects between front parts of the right and left sides; and b) a rear connector member, which connects between rear parts of the right and left sides;

such that the housing interior is configured to be accessible via a front upper opening, a rear upper opening, the loading aperture, and the bottom opening.

* * * * *